United States Patent [19]

Moranne

[11] Patent Number: 4,738,308

[45] Date of Patent: Apr. 19, 1988

[54] MECHANICALLY ASSEMBLED HEAT EXCHANGER OF THE TUBE AND FIN TYPE

[75] Inventor: Jean-Pierre Moranne, Saint-leu-la-Foret, France

[73] Assignee: Societe Anonyme des Usines Chausson, Hauts de Seine, France

[21] Appl. No.: 894,466

[22] Filed: Aug. 1, 1986

Related U.S. Application Data

[63] Continuation of Ser. No. 323,695, Nov. 20, 1981, abandoned.

[30] Foreign Application Priority Data

Nov. 24, 1980 [FR] France ..... 80 24894
Apr. 6, 1981 [FR] France ..... 81 06844

[51] Int. Cl.[4] ..... F28D 1/04; F28F 1/32; F28F 9/26

[52] U.S. Cl. ..... 165/149; 165/76; 165/173; 165/151

[58] Field of Search ..... 165/149, 175, 81, 173, 165/151, 76

[56] References Cited

U.S. PATENT DOCUMENTS

| | | | |
|---|---|---|---|
| 1,510,828 | 2/1925 | Chapin et al. | 165/149 |
| 2,932,489 | 4/1960 | Young | 165/149 |
| 3,165,151 | 1/1965 | Astrup et al. | 165/148 |
| 3,245,465 | 4/1966 | Young | 165/173 |
| 3,627,035 | 12/1971 | Astrup | 165/149 |
| 3,795,274 | 3/1974 | Fieni | 165/122 |
| 3,939,908 | 2/1976 | Chartet | 165/149 |
| 4,044,443 | 8/1977 | Chartet | 165/173 |
| 4,125,280 | 11/1978 | Kuzel | 165/175 |
| 4,331,201 | 7/1982 | Hesse | 165/173 |

FOREIGN PATENT DOCUMENTS

| | | | |
|---|---|---|---|
| 2435632 | 2/1975 | Fed. Rep. of Germany | 165/149 |
| 1939135 | 5/1980 | Fed. Rep. of Germany | 165/149 |
| 1442449 | 5/1966 | France . | |
| 2145383 | 2/1973 | France . | |
| 2148346 | 3/1973 | France . | |
| 2224727 | 10/1974 | France . | |
| 2238858 | 2/1975 | France . | |
| 2251794 | 6/1975 | France . | |
| 2259344 | 8/1975 | France . | |
| 2422921 | 11/1979 | France . | |
| 1278998 | 6/1972 | United Kingdom . | |
| 1387673 | 3/1975 | United Kingdom . | |
| 1482288 | 8/1977 | United Kingdom . | |
| 1484510 | 9/1977 | United Kingdom . | |
| 2054125 | 2/1981 | United Kingdom . | |
| 2090958 | 7/1982 | United Kingdom | 165/151 |

*Primary Examiner*—Albert W. Davis, Jr.
*Assistant Examiner*—John K. Ford
*Attorney, Agent, or Firm*—Browdy and Neimark

[57] ABSTRACT

The heat exchanger comprises tubes engaged into fins and tube plates connected to header boxes. The header boxes form on their smaller sides stirrups between the legs of which are defined inner edges on which are crimped the ends of platens formed by the tube plates. Moreover, the lugs of the side flanges are bent over on the sides of the stirrups.

14 Claims, 4 Drawing Sheets

MECHANICALLY ASSEMBLED HEAT EXCHANGER OF THE TUBE AND FIN TYPE

This is a continuation of application Ser. No. 323,695, filed Nov. 20, 1981, now abandoned.

BACKGROUND OF THE INVENTION

The present invention relates to heat exchangers of the type with tubes and fins, the tubes being fixed to the fins by an inflating operation without having to carry out a thermal treatment, and the ends of the tubes being themselves mechanically connected to the tube plates of a collector unit, and most often by means of resilient flanges providing the tightness.

BRIEF DESCRIPTION OF KNOWN PRIOR ART

French Pat. No. 74-02334 has disclosed an assembly mode according to which the tube plate is first engaged on the tubes, then receives a gasket and a header box. Finally, clamping lugs—formed either by an upstanding edge of the tube plate or by the end of a side flange—ensure clamping of the gasket.

U.S. Pat. No. 1,510,828 discloses an embodiment wherein the tubes are screwed into tube plates to which are then fixed header boxes and side flanges which are locked to the header boxes.

French Pat. No. 71-29093 discloses an oil radiator intended for being brazed, but wherein the constituent parts of which, in particular the tube plate, are first engaged on the tubes, then locked by lugs or spindles before placing a cover which is in turn maintained by turned-over lugs.

French Pat. No. 74-10078 discloses an embodiment wherein the tube plate is first fixed onto the ends of the tubes, this tube plate defining a peripheral groove into which is placed a gasket which is clamped by an edge of a header box maintained by crimping ensured by lugs bent-over from an outer upstanding edge of the tube plate. Some of the lugs of the tube plate are also used for being engaged into openings of flanges which are thus also fixed to said tube plate.

French Pat. No. 1,442,449 has disclosed, in an embodiment of an oil cooler, an arrangement wherein half-blades which are connected by side flanges having end lugs bent-over on either side of the extreme half-blades are stacked onto each other.

French Pat. No. 79-09343 has disclosed various ways for assembling metallic tube plates onto edges of header boxes made of a moulded material, with a view to providing a suitable tightness between the parts.

French Pat. No. 71-25459 has disclosed a mode of fixation for the side flanges wherein bent-over edges of the flanges are crimped into notches provided in cooling fins through which extend the tubes. The flanges are provided with accessories for supporting the heat exchanger unit without said flanges being in contact with the tube plates and with the header boxes covering them.

French Pat. No. 73-12174 discloses an embodiment wherein the side flanges are rigidly assembled to tube plates, but are provided with compensation means for compensating the differential dilatations occurring between the tubes and the flanges when the heat exchanger is in operation.

U.S. Pat. No. 3,627,035 discloses also an arrangement of a heat exchanger comprising tube plates and flanges which are fixed together, the tube plates being intended for receiving thereafter connection boxes.

OBJECTS OF THE INVENTION

A primary object of the invention is to provide a simple and inexpensive manufacture of a heat exchanger without having to use any connecting thermal process, and without the necessity of carrying out a double inflating operation of the tubes inside the fins, said double inflating operation being often necessary when it is required to first assemble the tubes into cooling fins, and then tube plates onto the tubes.

A particularly important object of the invention is an arrangement which allows manufacturing on the one hand the heat exchanger core as such, that is the tubes and the fins, by engaging the tubes into perforations of the fins, and then by carrying out an inflation step of the tubes, and on the other hand, manufacturing the tube plates -header box assemblies which can be either be integral or made of two assembled pieces. In this way, an important fraction of the time needed for the manufacture can be saved.

Moreover, the arrangement of the invention allows compensating the differential dilatations which can occur between the circulation tubes and the flanges whose temperature are often different.

A further advantage of the invention lies in the fact that the flanges which are provided with fixation members allow distributing the mechanical stresses on the one hand to the fins and on the other hand to the collector units, the distribution of the stresses being such that the connections between the tubes and fins on the one hand and between the tubes and collector units on the other hand cannot be damaged.

SUMMARY OF THE INVENTION

According to the invention, the heat exchanger of the type with tubes and fins wherein the tubes are inflated inside the fins, extend beyond said fins and are tightly engaged into gaskets of the tube plates preassembled with header boxes for forming a collector unit with side flanges being disposed on the smaller sides of the fins, is characterized in that the preassembled collector units are engaged onto the protruding portions of the tubes and in that said collector units and the flanges comprise mutual locking means, said flanges being also connected to the fins.

Several other characteristic features of the invention will become more apparent from the following description.

BRIEF DESCRIPTION OF THE DRAWINGS

Embodiments of the invention are shown by way of non limiting examples in the accompanying drawings, wherein.

DETAILED DESCRIPTION OF THE INVENTION

Figure 1:
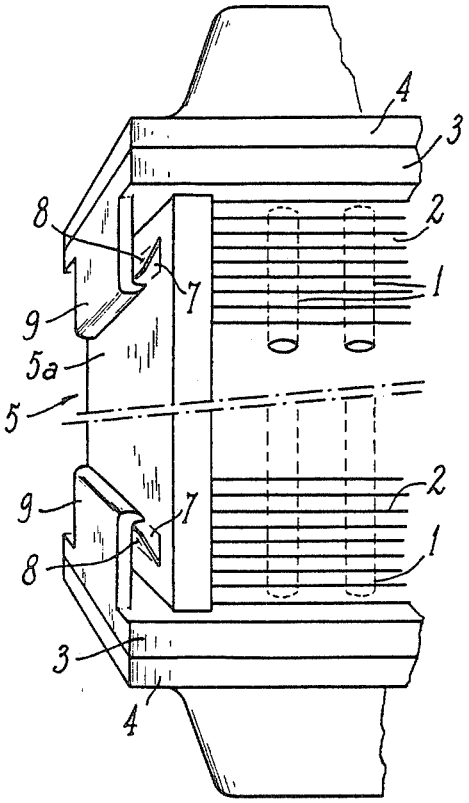
FIG. 1 is a partial perspective view of a heat exchanger embodying the invention.

The heat exchanger shown in FIG. 1 comprises in a known manner, circulation tubes 1 which are engaged into fins 2. The tubes 1 are rigidly fixed to the fins 2 by inflation, thereby providing the possibility of manufacturing the heat exchanger without any thermal treatment.

The end of the tubes 1 are engaged into tube plates 3, preferably of moulded material, particularly a synthetic resin, said tubes being tightly connected to said tube plates by means known in the art, such as for example by using resilient gaskets interposed between the passages of the tubes of said tube plate and the outer wall of the tubes.

The tube plates 3 are rigidly and tightly connected to header boxes 4, for example made of the same material as the tube plates. In the following description, the tube plates and header boxes assemblies are called collector units since such units, as described hereabove, can be made of two parts which are assembled mechanically, by welding, by ultrasounds, by gluing or by any other means, or they can possibly be made of a single piece by moulding, the art having taught different ways to achieve this end.

In the embodiments of FIGS. 1 to 4, the two collector units are connected together by side flanges 5 forming braces between these collector units for maintaining constant the distance between them and for possibly allowing the fixation of the heat exchanger via parts, not shown, connected to said flanges 5.

The flanges 5 of the embodiments according to FIGS. 1 to 5 are made of sections having substantially the shape of letter "C", i.e. they define a bottom 5*a*, lateral sides 5*b* and wings 5*c* extending towards each other.

Figure 2:
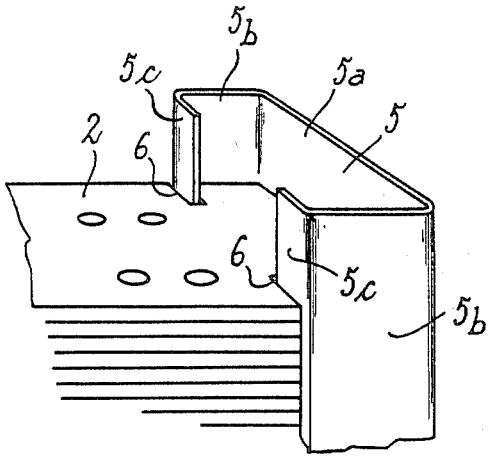
FIG. 2 is a partial perspective view illustrating a detail of embodiment of the heat exchanger of FIG. 1.

The fins 2 are formed, starting from their edges, with notches 6 provided to correspondingly cooperate with the wings 5*c* as shown in FIG. 2.

In FIG. 1, the bottom 5*a* of each flange comprises, near its ends, recesses 7 from which extend louvers 8 the position of which corresponds to that of hooks 9 provided on the collector units.

For manufacturing the radiator, the tubes are engaged into the fins, the tubes are inflated inside the fins, the side flanges 5 are slid into the notches 6 of the fins and the tube plates are engaged onto the protruding ends of tubes 1 until the hooks 9 move beyond the louvers 8 and come in engagement with them. In this last position, the bottom of the tube plates 3 is bearing against the corresponding end of the flanges 5.

Figure 3:
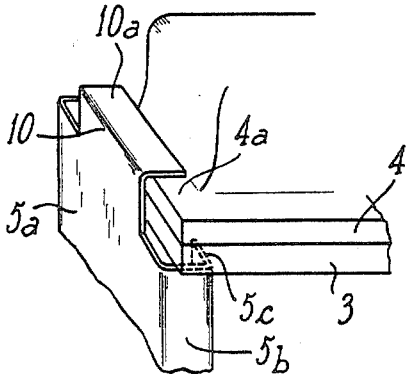
FIGS. 3 and 4 are partial perspective views of two alternative embodiments.

FIG. 3 illustrates an alternative embodiment wherein the bottom 5*a* of the flanges 5 extends into a lug 10 the end 10*a* of which is bent over a bearing surface 4*a* of the header box 4.

The drawings shows that the wings 5*c* and possibly the sides 5*b* act as bearing abutments for the tube plate 3.

Figure 4:
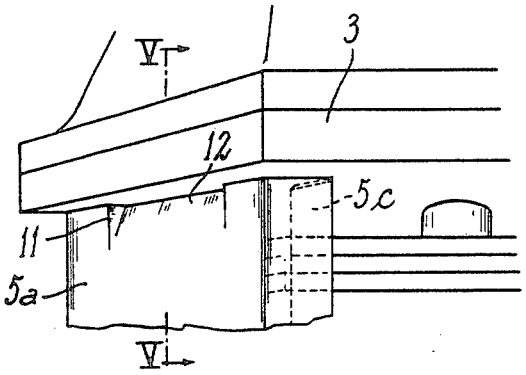
Figure 5:
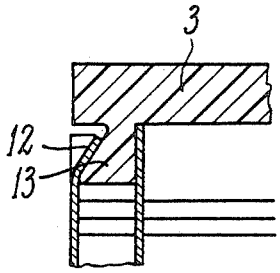
FIG. 5 is a partial sectional view along line V—V of FIG. 4.

In the embodiment of FIGS. 4 and 5, the bottom 5*a* of the flanges is formed, at its ends, with cutouts 11 defining a louver 12. On the other hand, the tube plate 3 is formed on its bottom portion with a moulding 13.

When all the parts of the heat exchanger are assembled, the louver 12 is bent over so as to mate with moulding 13.

Figure 6:
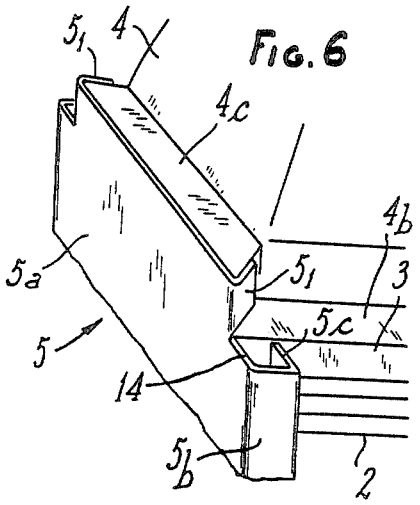
FIG. 6 is a partial perspective view of an alternative embodiment.

FIG. 6 illustrates an alternative embodiment wherein each flange 5 is made of a "U" shaped section defining, as previously, a bottom 5*a* and sides 5*b* extending in the direction of the fins 2.

The flange sides 5*b* are formed with cut-outs 14 near their end and the header box 4 defines, on its larger sides, edges 4*b*, and, on its smaller sides, retaining flaps 4*c*. The upper portion of the sides 5*b* defined by the cut-outs 14 forms tongs $5_1$ which are bent over on either side of the flaps 4*c* while bearing against the edge 4*b*, thereby locking the collector unit in the same way as in the previously described embodiments.

Figure 7:
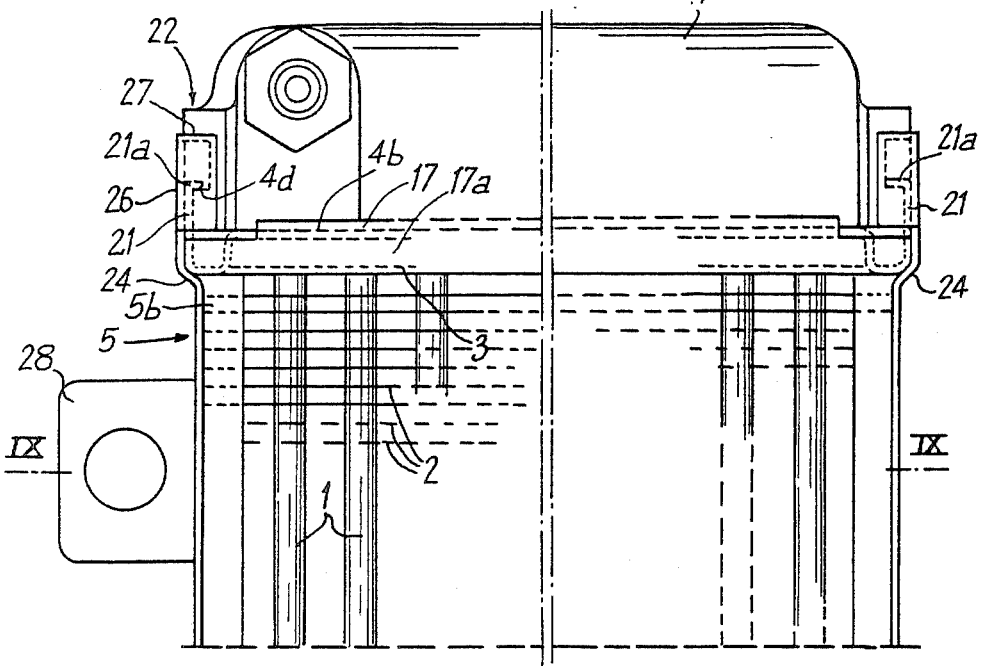
FIG. 7 is a partial diagrammatic elevation view of a heat exchanger embodying the invention.

In FIG. 7 and the following figures, the tube plates 3 define over their whole periphery an upstanding edge 17*a* from which are formed crimping members 17. On the smaller sides of the tube plates, the crimping members are formed by the ends 21*a* of a platen 21 which projects notably above the upstanding edge 17*a*, as particularly shown in FIG. 7.

The tube plates 3 at the two ends of the tubes are designed for being assembled with header boxes 4 having an edge 4*b* on their larger sides and edges 4*d* on their smaller sides.

Moreover, each header box defines on its smaller sides a stirrup 22, the legs 22*a*, 22*b* (FIG. 10) of which protrude relative to the portion of the box forming the edge 4*d*, the measure of the projection of the stirrup corresponding at least to the thickness of the metal constiting the platen 21 formed at each end of the tube plates.

Figure 8:
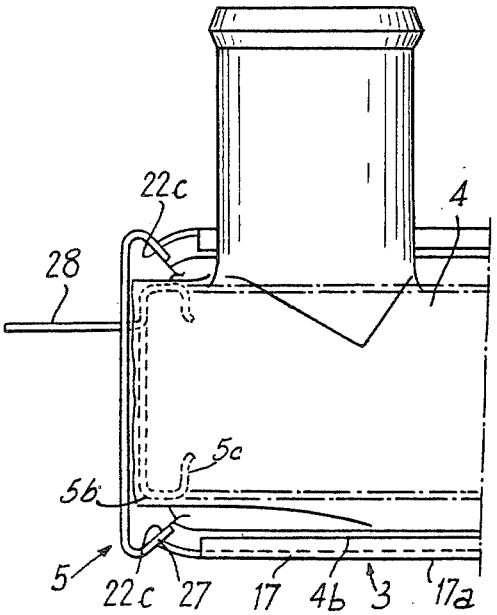
FIG. 8 is a top view corresponding to FIG. 7.
Figure 9:
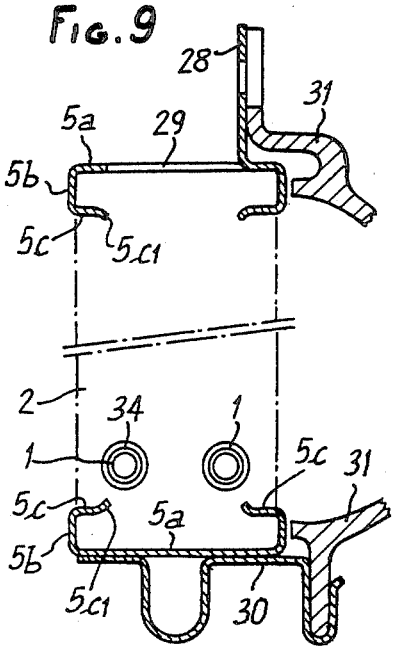
FIG. 9 is a transverse sectional view substantially along line IX—IX of FIG. 7.
Figure 10:
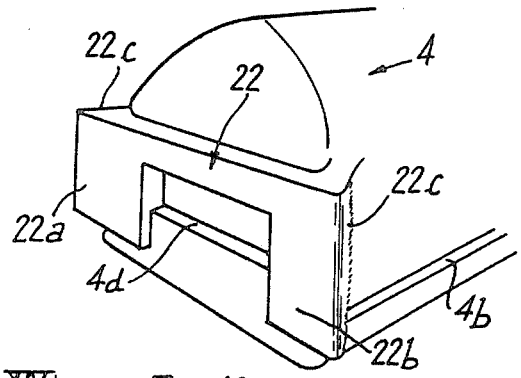
FIG. 10 is a partial perspective view of a header box which is part of the heat exchanger of the above figures.
Figure 11:
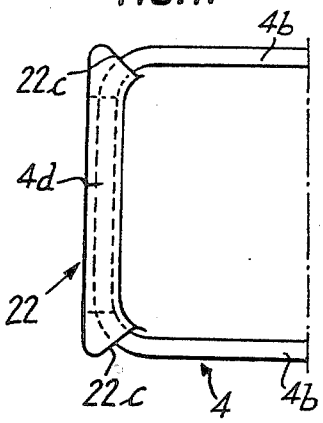
FIG. 11 is a partial plan view as seen from the top of the header box of FIG. 10.
Figure 12:
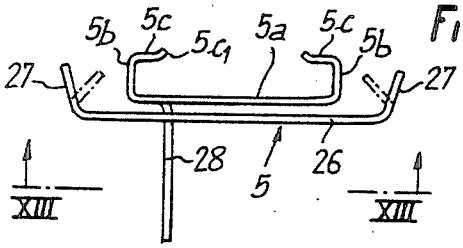
FIG. 12 is a view from the top of one of the side flanges which are part of the heat exchanger of FIGS. 10 and 11.

The stirrup forms on its lateral sides bent-back edges 22*c* which are well visible in FIGS. 8, 10 and 11. FIGS. 9 and 12 show that the flanges have, from their bottom portions 5*a*, bent-back sides 5*b* and wings 5*c* the end $5c_1$ of which is curved.

Figure 13:
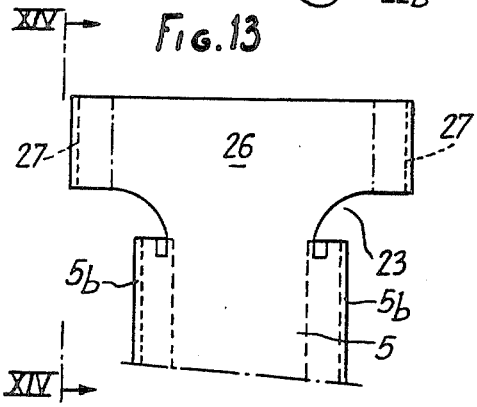
FIG. 13 is an elevation view substantially along line XIII—XIII of FIG. 12.
Figure 14:
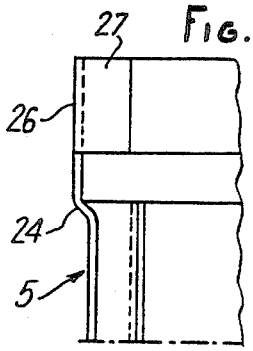
FIG. 14 is a partial elevation view substantially along line XIV—XIV of FIG. 13.

The wings 5*c* are designed for being engaged into the notches of the fins 2 by a sliding movement. Sides 5*b* and wings 5*c* have a length corresponding to the distance which normally separate the two tube plates of the heat exchanger. The flanges 5 form, beyond the ends of sides 5*b* and wings 5*c*, indentations 23 (FIG. 13), and a shoulder 24 at the level of said sides 5*b*.

Beyond the shoulder 24, each end of the flanges forms a flat segment 26 laterally bordered by lugs 27.

The height of the indentations 23 is chosen such that the lugs 27 can be bent above the edge 4*b* of the header boxes 4 or above the crimping members of the tube plates.

Moreover, the flanges 5 form, in various suitable positions, supports 28, for example sticking up from recesses 29 and in a similar way the flanges possibly support added parts 30 (FIG. 9) which are welded or attached by any other means. The supports 28 and the added parts 30 are used for the fixation of the heat exchanger and members 31, for example the support of a motor-ventilator.

The crimping members may be made in different ways. FIG. 15 shows an embodiment wherein the crimping members are formed by an extension 17$a_1$ of the upright edge 17*a*, perforations 32 being provided from place to place between the upstanding edge 17*a* and the extension 17$a_1$, said perforations extending substantially at the position of the edges 4*b* of the header boxes 4.

Figure 15A:
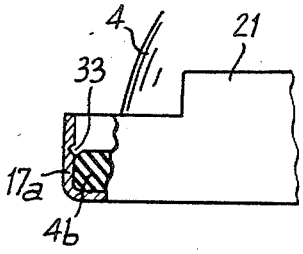
FIGS. 15 to 15*b* are partly exploded elevation views illustrating particular embodiments of the tube plates of the preceding figures.
Figure 15:
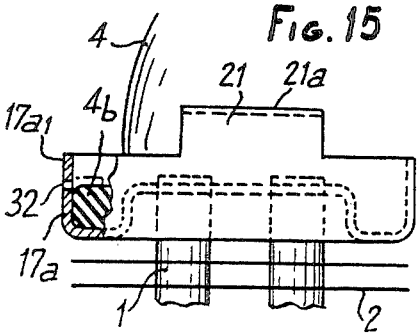

In FIG. 15*a*, the perforations 32 are substituted by a groove 33 extending over all or part of the length of the upstanding edge 17*a* near the upper level of the edge 4*b* of the header box.

Figure 15B:
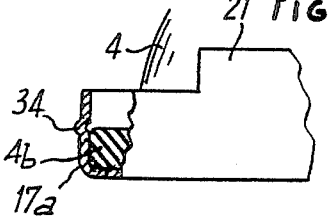

In FIG. 15*b*, a hollow rib 34 is formed in the vicinity of the upper portion of the edge 4*b*.

One would not depart from the scope of the invention if there was no particular member between the upstanding edge 17*b* and the extension, the means hereabove described being in fact provided only for facilitating a possible disassembly of the header box and the corresponding tube plate.

The assembly of the described heat exchanger is carried out in the following meanner :

The tubes plates and header boxes sub-assemblies are prepared separately, i.e. the crimping elements are crimped onto the edge 4*b* and the ends 21*a* of the platens 21 are crimped in the same manner onto the edge 4*d* of the smaller sides of the header box. The width of the platens 21 is chosen such that they extend between the inner sides of the legs 22*a*, 22*b* the stirrups 22 formed by the header boxes and, after crimping, the platens 21 are completely enclosed without protruding between the legs 22*a*, 22*b* of the stirrup 22.

In a generally known manner, the tube passages provided in the tube plates are fitted with deformable gaskets 34 (FIG. 9) which can be put in position indifferently before or after the assembly of the tube plates and header boxes.

On the other hand, the core as such of the heat exchanger is prepared, that is the tubes 1 and the fins 2 which are engaged on the tubes 1. The tubes 1 are for example inflated into a bundle of fins in order to obtain their mutual fixation and a good thermal transmission between these members.

The flanges 5 are also put in position by engaging their wings 5*c* inside the notches formed in the fins. The curved ends 5$c_1$ of the wings 5*c* act as non sliding hooks which facilitate maintaining the flanges on the fins.

The tube plates and header boxes sub-assemblies are then set in position on the projecting ends of the tubes 1 by simply engaging the tubes into the resilient gaskets 34. At end of the engagement, the bottom portion of the tube plates abuts against the ends of the wings 5*c* of the sides 5*b* and on the shoulder 24 of the flanges 5. The flat segment formed at both ends of each flange comes then to bear against the outer face of the stirrup 22. Finally, the lugs 27 are bent over as illustrated in FIGS. 8 and 12, their bottom portion coming to bear against the top of the edges 4*b* of the header boxes, as shown in FIGS. 1 and 2. Should the case arise, the lugs 27 could rest against the crimping members 17.

The flanges ensure therefore a fixation both of the tube plates and the header boxes so that no relative movement can occur between the two tube plates header boxes sub-assemblies relative to the flanges and to the core as such.

I claim:

1. A completed and water-tight heat exchanger comprising:

a radiator core first assembly comprising a plurality of fins and a plurality of tubes assembled together, with said fins having lateral notches, two collector units each comprising a head box and a tube-plate rigidly connected together, said collector units being located at opposite ends of said radiator core first assembly;

mechanical locking means for mechanically locking together the two collector units with said radiator core first assembly therebetween, said mechanical locking means including side flanges having folded portions with the ends of said side flanges coming into abutment against both said collector units and engaged into the lateral notches of said fins, said mechanical locking means further including means placed at a fixed distance with respect to said ends of said flanges, for locking said collector units preventing them from being displaced from the radiator core first assembly.

2. A heat exchanger according to claim 1, wherein the side flanges define means for bracing the two collector units.

3. A heat exchanger according to claim 1, wherein the locking means engaging the tube plate comprise bent-over lugs.

4. A heat exchanger according to claim 1, wherein the mechanical locking means comprise projecting hooks formed from said collector units which interlock with louvers projecting from recesses formed in vicinity of ends of the side flanges, said louvers constituting said means placed at a fixed distance with respect to said ends of said flanges.

5. A heat exchanger according to claim 1, wherein the mechanical locking means comprise as part of said side flanges side lugs bent over flaps formed by the head box of each collector unit, the tube plate of each head box forming an edge on which bear said side lugs.

6. A heat exchanger according to claim 1, wherein the side flanges are "C" shaped and defined two wings turned toward each other, said wings being engaged into said lateral notches formed in said fins.

7. A heat exchanger according to claim 1. wherein the head boxes include, on their smaller sides, stirrups and said tube plates include a correspondingly disposed crimping edge, said stirrups projecting beyond said crimping edges and having bent-back side edges on which lugs, formed at the ends of the side flanges, are bent over.

8. A heat exchanger according to claim 7, wherein the lugs which are crimped on the bent-back sides of the stirrups cooperate via their bottom portion for retention with the top of the edge on which are crimped the crimping edges of the tube plates.

9. A heat exchanger according to claim 7, wherein the bottom of each flange includes a shoulder at the end of each side and wing for supporting the smaller sides of the tube plates, said shoulder being prolongated by a flat segment on the sides on which are formed the lugs crimped onto the bent-back side edges of the stirrup of the header box.

10. A heat exchanger according to claim 1, wherein the flanges include supports formed with means for fixing the heat exchanger to accessories.

11. A heat exchanger according to claim 1, wherein the ends of the folded portions formed by the flanges are curved.

12. A heat exchanger according to claim 1, wherein the mechanical locking means comprise an extension of an upstanding edge of the tube plate, and are spaced from said upstanding edge.

13. A completed and water-tight heat exchanger comprising:

a radiator core first assembly comprising a plurality of fins and a plurality of tubes assembled together, with said fins having lateral notches, two collector units each comprising a head box and a tube-plate rigidly connected together, said collector units being located at opposite ends of said radiator core first assembly; and mechanical locking means for mechanically locking together the two collector units with said radiator core first assembly therebetween, said mechanical locking means comprising a pair of side flanges extending along opposite sides of said radiator core first assembly and between said two collector units, each said side flange having lateral folded portions which engage into the lateral notches of said fins and which have ends abutting said collector units, said side flanges further having opposite end portions each of which hooks over and thereby interlocks with a cooperating portion on said collector unit located at a fixed distance with respect to the respective end of said side flange, whereby side collector units are locked together on both sides by said side flanges with said radiator core first assembly therebetween.

14. A completed and water-tight heat exchanger comprising:

a radiator core first assembly comprising a plurality of fins and a plurality of tubes assembled together, with said fins having lateral notches, two collector units each comprising a head box and a tube-plate rigidly connected together, said collector units being located at opposite ends of said radiator core first assembly; and mechanical locking means for mechanically locking together the two collector units with said radiator core first assembly therebetween, said mechanical locking means including a pair of side flanges extending longitudinally between two ends thereof along opposite sides of said radiator core first assembly and between the two collector units, each said side flange having folded lateral portions which engage into the lateral notches of said fins, said folded portions having opposite ends which abut against said collector units thereby fixing a minimum distance between the two collector units, said mechanical locking means further including cooperative interlocking elements on said collector units and the ends of said side flanges, said cooperative interlocking elements being crimped together whereby said collector units are locked together on both sides by said side flanges and prevented from being displaced from the radiator core first assembly located therebetween.

* * * * *

UNITED STATES PATENT AND TRADEMARK OFFICE

CERTIFICATE OF CORRECTION

PATENT NO. : 4,738,308

DATED : April 19, 1988

INVENTOR(S) : MORANNE, Jean-Pierre

It is certified that error appears in the above-identified patent and that said Letters Patent is hereby corrected as shown below:

Column 2, line 19, delete "be (first occurrence)

Column 5, line 25, "tubes" should be --tube--

Signed and Sealed this

Fourth Day of October, 1988

*Attest:*

DONALD J. QUIGG

*Attesting Officer*

*Commissioner of Patents and Trademarks*